United States Patent [19]

Orrill et al.

[11] 4,148,257

[45] Apr. 10, 1979

[54] EXPLOSIVE CUTTING DEVICE

[75] Inventors: Larry M. Orrill, Arlington; John A. Regalbuto; Michael L. Wilson, both of Fort Worth; Wayne L. Rutledge, Arlington, all of Tex.

[73] Assignee: Halliburton Company, Duncan, Okla.

[21] Appl. No.: 815,346

[22] Filed: Jul. 13, 1977 (Under 37 CFR 1.47)

[51] Int. Cl.[2] ..... F42B 3/08

[52] U.S. Cl. ..... 102/24 HC; 114/221 A

[58] Field of Search ..... 102/20, 24 HC, 28 EB; 114/221 A; 89/1 B

[56] References Cited

U.S. PATENT DOCUMENTS

| | | | |
|---|---|---|---|
| 2,984,307 | 5/1961 | Barnes | 102/20 X |
| 3,089,417 | 5/1963 | Beyer et al. | 102/24 HC |
| 3,208,380 | 9/1965 | Scherrer | 102/28 EB |
| 3,245,485 | 4/1966 | Bell | 102/24 HC |
| 4,057,026 | 11/1977 | Nabucet et al. | 102/24 HC |

*Primary Examiner*—Verlin R. Pendegrass

*Attorney, Agent, or Firm*—John H. Tregoning; James R. Duzan

[57] ABSTRACT

An explosive cutting device comprising an upper and lower member, each having a charge retaining area and a standoff area, a linear shaped explosive charge contained within each charge retaining area of the upper and lower member, a pair of anti-jet distortion members located on both the upper and lower member thereby defining an opening between the upper and lower member into which a target member to be severed is placed, a fastening means for securing the upper member to the lower member, and means for detonating the linear shaped explosive charge within the upper and lower member.

37 Claims, 12 Drawing Figures

EXPLOSIVE CUTTING DEVICE

BACKGROUND OF THE INVENTION

This invention relates to an explosive cutting device for cutting chain links, rods, bars, cables, lines, and the like, particularly disposed beneath the surface of water, at a a preselected time or distance from the surface of the water.

It is often desirable to temporarily anchor floating vessels such as drilling ships, floating drilling platforms, buoys and the like in great depths of water. Such vessels are held stationary on the surface of the water by a length of anchor chain, cable or line attached to an anchoring means. In offshore operations it is desirable to have a reliable, quickly releasable anchor system. Typical unpredictable conditions experienced by offshore drilling ships, floating drilling platforms, and the like, which require the drilling ship or floating drilling platform to be moved as quickly as possible from anchorage, include adverse weather conditions, blowouts, drifting icebergs or any other emergency situations.

In the past, offshore drilling ship and floating drilling platform anchor chain release mechanisms have been cumbersome to install, expensive to purchase and require periodic maintenance to insure reliability. For example, a prior art hydraulic anchor chain release mechanism which is installed between the anchor on the ocean floor and the anchor chain is approximately 103 inches in length, 24 inches in diameter, and weighs 4,400 pounds on land.

Another prior art explosive cutting device for use on anchor chains, which merely comprised two shaped charges that were installed on an anchor chain link and detonated by explosive detonating cord, was found to be unsatisfactory in service since it required the shaped charges to extend one foot or more on either side of the anchor chain link to insure the severing of the anchor chain link upon detonation.

In contrast to the prior art devices, the present invention provides an explosively actuated anchor chain cutting device which comprises an upper member and a lower member, each having linear shaped explosive charge contained therein, the members being held about an anchor chain link by any suitable fastening means and a means for detonating the explosive charge in the upper and lower member respectively. When compared to the prior art anchor chain release mechanisms or cutters, the present invention is relatively inexpensive, can be easily installed and manipulated by a technician, and requires a minimum of periodic maintenance. The present invention also offers the advantage of severing relatively large diameter anchor chain links using a minimum amount of linear shaped explosive charge since the linear shaped explosive charge in each member of the explosive cutting device is simultaneously detonated. This provides a jet of hot gases and particulate materials which cut from both sides of the anchor chain link simultaneously. In conjunction with the simultaneous detonation of the linear shaped explosive charges in the upper and lower members of the cutting device, the present invention further includes anti-jet distortion members which allow the jet and particulate material emanating from each linear shaped explosive charge to remain undistorted by the surrounding environment thereby insuring complete severing of the anchor chain link.

DETAILED DESCRIPTION

Figure 1:
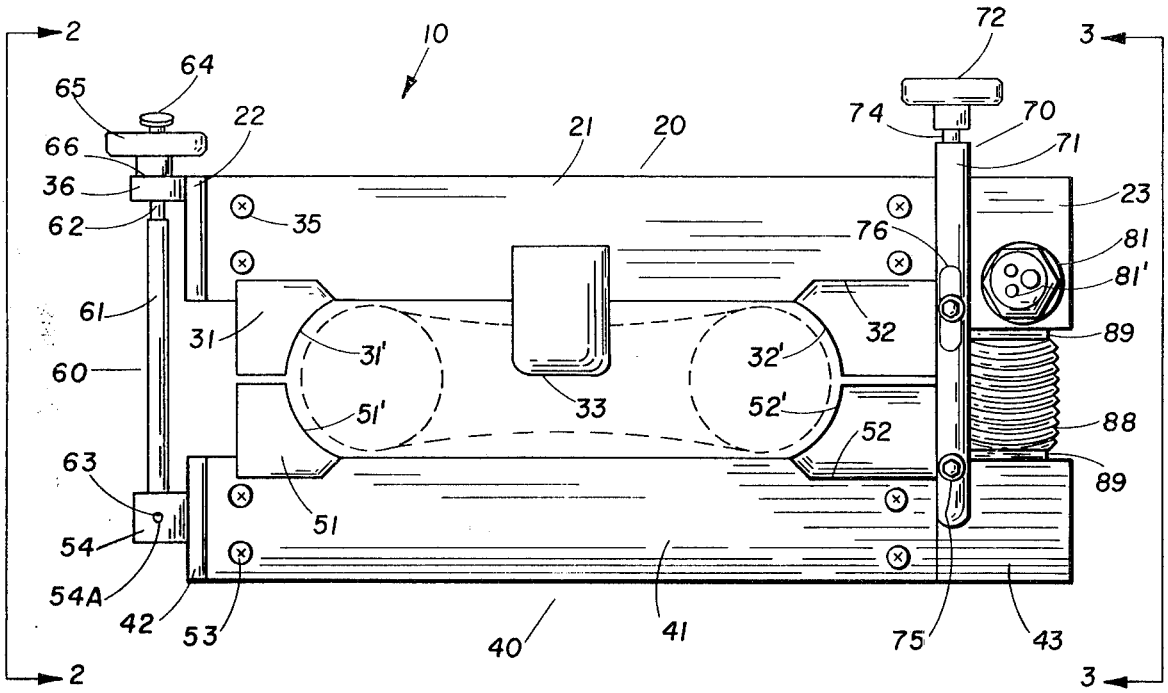
FIG. 1 shows the preferred embodiment of the explosive cutting device.

Referring to FIG. 1, the explosive cutting device 10 is shown in its preferred form. The explosive cutting device 10 comprises an upper member 20 and a lower member 40.

The upper member 20 comprises an elongated hollow central member 21, end caps 22 and 23, anti-jet distortion members 31 and 32, and anchor chain link spacers 33. The end caps 22 and 23 are secured to the central member 21 by means of screws 35 and any suitable adhesive material (not shown) capable of forming a hermetic seal between the end caps 22 and 23 and the central member 21. The anti-jet distortion members 31 and 32 are welded to the central member 21 and are pressure checked after welding to insure a hermetic seal between the anti-jet distortion members 31 and 32 and the central member 21. The anti-jet distortion members 31 and 32 are formed with arcuate faces 31' and 32' respectively to substantially abut the outer periphery of an anchor chain link (shown in phantom) to be severed.

The anchor chain link spacers 33 are rectangular in shape and are fastened in the center of the upper central member 21 by any suitable fastening means, such as welding.

The lower member 40 comprises central member 41, end caps 42 and 43, and anti-jet distortion members 51 and 52. The end caps 42 and 43 are secured to the central member 41 by means of screws 53 and any suitable adhesive material (not shown) capable of forming a hermetic seal between the end caps 42 and 43 and the central member 41. The anti-jet distortion members 51 and 52 are welded to the central member 41 and are pressure checked after welding to insure a hermetic seal between the anti-jet distortion members 51 and 52 and the central member 41. The anti-jet distortion members 51 and 52 are formed with arcuate faces 51' and 52' respectively to substantially abut the outer periphery of the anchor chain link (shown in phantom) to be severed.

As further shown in FIG. 1, the upper member 20 and lower member 40 are fastened at one end by means of a yoke 70 while the other end of each member is detachably secured by means of a pivotally threaded fastener 60.

The yoke 70 comprises a U-shaped member 71 and a thumbscrew. The U-shaped member is fastened to end cap 43 of lower member 40 by means of screws 75 threadedly engaging end cap 43 while the end cap 23 of upper member 20 is free to slide vertically relative to the lower member 40 by means of screws 75 engaging slots 76 in U-shaped member 71 while threadedly engaging end cap 23. The relative spacing between the upper member 20 and lower member 40 is determined by means of a thumbscrew having a knob 72 secured to threaded member 74 by means of setscrew 73. The threaded member 74 engages a threaded aperature in U-shaped member 71 and bears against the upper surface of end cap 23. The slots 76 in U-shaped member 71 are of sufficient length to allow the anti-jet distortion member 32 of the upper member 20 to abut anti-jet distortion member 52 of the lower member 40 while compensating for normal anchor chain link manufacturing tolerances.

The other end of the upper member 20 and lower member 40 are detachably secured by means of a pivotally threaded fastener 60 comprising a partially threaded stem 61, a pin 63 and a threaded knob 65. The lower end of the stem 61 is pivotally attached to end cap 42 of lower member 40 by means of pin 63 mating with hole 54A of the ears 54 on end cap 42. The upper end of stem 61 has knob 65 threaded thereon at the stem's threaded portion 62. Removal of knob 65 from threaded portion 62 is prevented by enlarged stem area 64. To fasten the upper member 20 to the lower member 40 the threaded section 62 of stem 61 is positioned between ears 36 of end cap 22 so that when knob 65 is tightened the lower surface 66 of knob 65 abuts the upper surface of the ears 36 thereby forcing anti-jet distortion members 31 and 51 together.

As additionally shown in FIG. 1, although not a load carrying support, the upper member 20 is further connected to the lower member 40 by means of a bellows 88 which is attached to end cap 23 of upper member 20 and end cap 43 of lower member 40 by means of adjustable bands 89. Alternatively, the bellows 88 may be adhesively bonded to the end cap 23 of the upper member 20 and end cap 43 of lower member 40 by means of any suitable adhesive material.

A threaded connector 81 having three connector pins 81', two of which are smaller in diameter than the third which serves as a centering device when mating with a suitable connector, is shown in FIG. 1 in end cap 23 of upper member 20.

Figure 2:
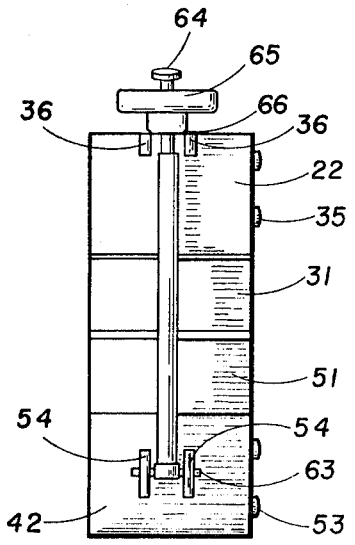
FIG. 2 is an end view taken along lines 2—2 of FIG. 1.
Figure 3:
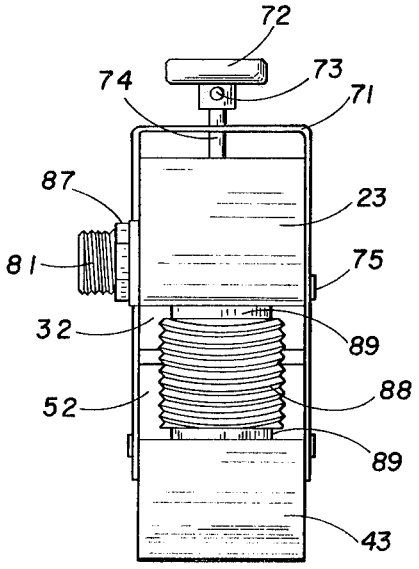
FIG. 3 is an end view taken along lines 3—3 of FIG. 1.

As shown in FIG. 2 and FIG. 3, the end caps 22, 23, 42 and 43 are generally square in cross section although the upper member 20 and lower member 40 may be constructed of any geometric cross-sectional shape. In FIG. 2, the pin 63 is shown securing the lower end of stem 61 to the ears 54 of end cap 42 while the lower surface 66 of threaded knob 65 is shown engaging the upper surface of ears 36 an end cap 22.

Figure 4:
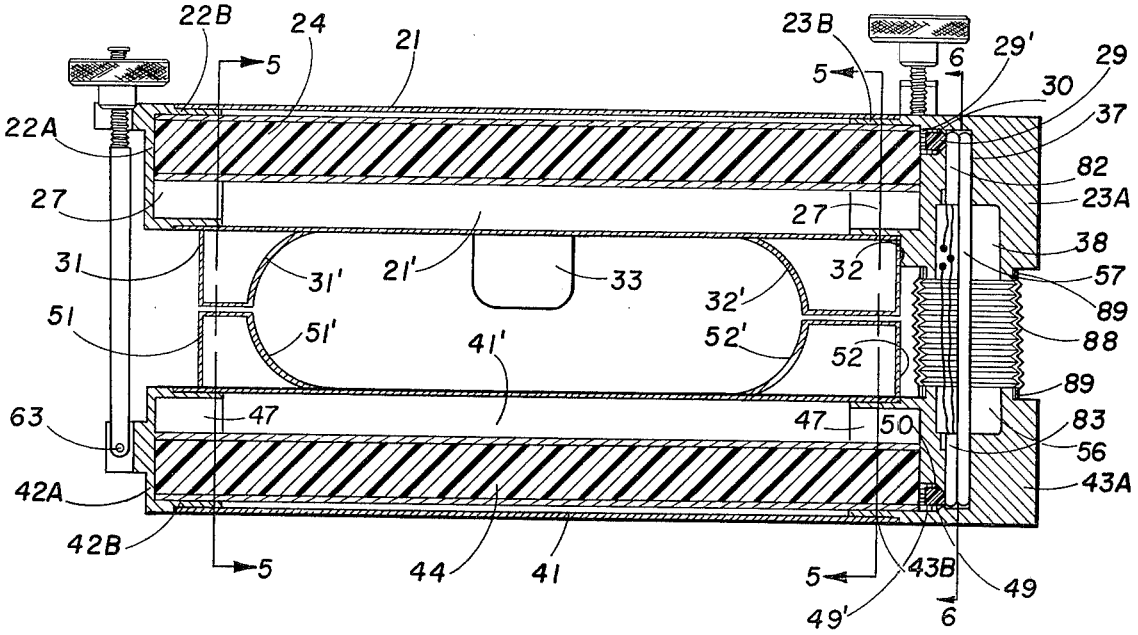
FIG. 4 is a cross-sectional view of the preferred embodiment of the invention with the explosive charge shown in full cross section.

As shown in FIG. 4, linear shaped charges 24 and 44 are contained in the upper member 20 and the lower member 40 respectively. The linear shaped charge 24 extends the length of the upper portion of the central member 21 and into end caps 22 and 23 abutting end cap walls 22A and 23A respectively. As shown in FIG. 4, standoff spaces 27 and 21' are provided by the end caps 22 and 23 and central member 21 respectively. Similarly, the linear shaped charge 44 extends the length of the lower portion of the central member 41 and into end caps 42 and 43 abutting end cap walls 42A and 43A respectively. Standoff spaces 47 and 41' are provided by the end caps 42 and 43 and central member 41 respectively.

To form a flush exterior joint between the end caps and their respective central members the end caps are formed with reduced thickness walls. The reduced thickness cap walls are shown as 22B, 23B, 42B and 43B in FIG. 4.

As shown in FIG. 4, the anti-jet distortion members 31, 32, 51 and 52 are hollow, although they could be solid members. By forming the anti-jet distortion members 31, 32, 51 and 52 as hollow members, upon detonation of the linear shaped charges, the anti-jet distortion members allow the jet to remain unaffected by the surrounding environment thereby insuring the severing of the anchor chain link about its outer periphery.

A booster charge 29 having a metal casing 29' is located in bore 30 of end cap 23 in direct contact with the linear shaped charge 24 in upper member 20. Similarly, a booster charge 49 having a metal casing 49' located in bore 50 of end cap 43 of lower member 40 in direct contact with the linear shaped charge 44 in lower member 40.

The booster charge 29 is also in direct contact with an exploding bridgewire (EBW) detonator 82 located in bore 37 of end cap 23. The EBW detonator 82 is in further contact with an explosive detonating cord 57 installed in bore 37 of end cap 23.

Similarly, the booster charge 49 is also in direct contact with an exploding bridgewire (EBW) detonator 83 located in bore 55 of end cap 43. The EBW detonator 83 is in further contact with the explosive detonating cord 57 which, as described hereinbefore, has one end in contact with EBW detonator 82 in end cap 23.

Although not shown in FIG. 4, after the EBW detonator 82 and exploding detonator cord 57 are installed in bore 37 of end cap 23, the cavity 38 in end cap 23 is filled with any suitable potting material to hold the EBW detonator 82 and exploding detonator cord 57 in position and to hermetically seal the interior of the end cap 23.

Similarly, the cavity 56 in end cap 43 is filled with any suitable potting material to hold the EBW detonator 83 and exploding detonator cord 57 in position and to hermetically seal the interior of the end cap 43 after the EBW detonator 83 and exploding detonator cord 57 are installed in bore 55 of end cap 43.

Figure 5:
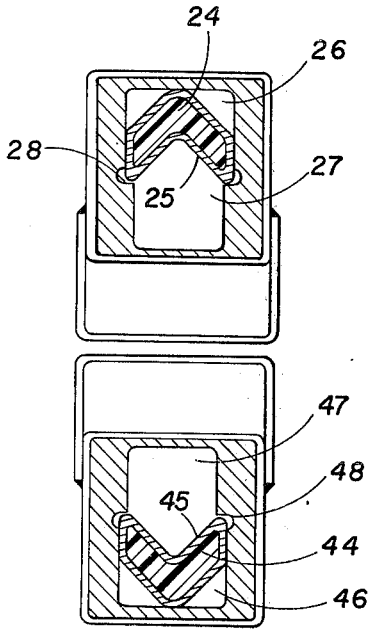
FIG. 5 is an enlarged cross-sectional view taken along either set of lines 5—5 of FIG. 4.

As shown in FIG. 5, the end caps 22 and 23 are divided into a charge retaining area 26 and a smaller standoff area 27 by means of a shoulder 28. Similarly, the end caps 42 and 43 are divided into a charge retaining area 46 and a smaller standoff area 47 by means of a shoulder 48.

As further shown in FIG. 5, the linear shaped charge 24 is installed with its operative face 25 facing the standoff area 27 while the linear shaped charge 44 is installed with its operative face 45 facing standoff space 47.

Figure 6:
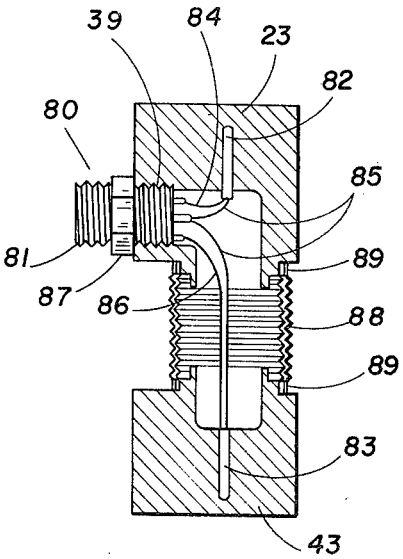
FIG. 6 is a cross-sectional view taken along lines 6—6 of FIG. 4 with the connector shown in full side view.

As shown in FIG. 6, the EBW detonator assembly 80 comprises a three pin threaded connector 81, which is threaded into threaded bore 39 in end cap 23, a locking nut 87, connecting wires 84, 85, 86 and the EBW detonators 82 and 83. The EBW detonators 82 and 83 are well known in the art and commercially available. Although not shown in detail, each EBW detonator 82 and 83 comprises a header and a sleeve. The header contains the electric wire leads and the bridgewire while the sleeve portion of the EBW detonator contains explosive material. To function as a EBW detonator, electrical energy is applied to the bridgewire. The rate of this energy application and its magnitude result in the explosion of the bridgewire in the detonator. As the bridgewire explodes, the shock wave and thermal energy are transferred into the explosive material which, in turn, explodes. As shown, the EBW detonators are connected in series with conductors 84 and 86 being connected to the smaller pins of the connector 81 while the larger centering pin serves as a common connection point for conductors 85.

The linear shaped charges 24 and 44 as shown in FIG. 4 and FIG. 5 are well known in the art as a device for creating a directed jet of high temperature and high velocity gases as well as high velocity particulate material upon detonation. As commercially available, the linear shaped charges 24 and 44 are formed with a copper sheathing material containing the desired explosive material.

As well known in the art, to be operative, shaped charges must be positioned so as to provide standoff spaces between their operative faces of the charges and the target to be severed. As shown in FIG. 4 and FIG. 5, the linear shaped charges 24 and 44 are positioned to provide standoff spaces 21', 27, 41' and 47 between the operative faces 25 and 45 of the charges 24 and 44 respectively, and the portion of the upper member 20 and lower member 40 in contact with the anchor chain link (the target) to be severed. To insure complete severing of the anchor chain link about its outer periphery by the linear shaped charges 24 and 44, anti-jet distortion members 31, 32, 51 and 52 are provided about the outer periphery of the anchor chain link. The anti-jet distortion members 31, 32, 51 and 52 as well as standoff spaces 21', 27, 41' and 47 allow the proper formation of the jets and prevent distortion of the jets emanating from the operative faces 25 and 45 of linear shaped charges 24 and 44 where severing is desired. At this juncture, it should be noted that when severing anchor chain link, although anti-jet distortion members 31, 32, 51 and 52 are required about the outer periphery of the anchor chain link to insure complete severing of the link, anti-jet distortion members are not required about the inner periphery of the anchor chain link. The reason being that since anchor chain links are formed with a stud link spanning the middle portion of the anchor chain link, since the explosive cutting device 10 is installed about the anchor chain link with the link centering members 33 on either side of the stud link thereby engaging the explosive cutting device 10 with the stud link as well as the anchor chain link, and since the stud link and anchor chain link exclude most of the surrounding environment between the anti-jet distortion members 31, 32, 51 and 52 of the upper member 20 and lower member 40 of the explosive cutting device 10, the anchor chain link and stud link, in conjunction, prevent any substantial distortion of the jets and particulate material emanating from the linear shaped charges 24 and 44 upon detonation thereby allowing the inner periphery of the anchor chain link to be severed while the stud link is either severed or physically forced from the center of the anchor chain link intact.

The linear shaped charges 24 and 44 may be formed from any high detonating velocity explosive material. Examples of commercially available explosive materials suitable for use in the linear shaped charges 24 and 44 are given in TABLE I below:

TABLE I

| EXPLOSIVE MATERIALS | | |
|---|---|---|
| Symbol | Chemical | Formula |
| RDX | Cyclotrimethylenetrinitramine, Hexahydro-1, 3,5-Trinitro-5-Triazine, Cyclonite, Hexogen, T4 | $C_3H_6N_6O_6$ |
| PETN | Pentaerythrite Tetranitrate, Penta, Pentrit, Nitro Pentaerythrite | $C(CH_2NO_3)_4$ |
| COMP B | Cyclotol | (RDX + TNT + Polyisoluctylene +Wax) (55.2/40/1.2/3.6) |
| COMP C | Plasite | (RDX & Plasticizers - Various Percentages) |
| COMP C1 | Plastite | (RDX & Plasticizer) (88.3/11.7) |
| COMP C2 | Plastite | (RDX & Plasticizer) (78.7/21.2) |
| COMP C3 | Plastite | (RDX & Plasticizer) (77/23) |
| COMP C4 | Harrsite | (RDX & Plasticizer) (91/9) |
| HNS | Hexanitrostibene | $C_{14}H_6N_6O_{12}$ |
| DATB | Diaminotrinitrobenzene | $C_6H(NO_2)_3(NH_2)_2$ |
| CH-6 | RDX/Calcium Stearate/Others | (97.5/1.5/1.0) |
| TETRYL | 2,4,6-Trinitrophenylmethylnitramine, Tetralite, Pyronite, CE | $C_7H_5N_5O_8$ |

The preferred explosive is cyclotrimethylenetrinitramine (RDX). Various size charges of the explosive may be used for anchor chain links of various sizes. For example, when using two linear shaped charges juxtaposed about the anchor chain link and detonated simultaneously, for cyclotrimethylenetrinitramine (RDX) to sever a one inch diameter anchor chain link requires a linear shaped charge explosive density of 600 grains per foot, to sever a two inch diameter anchor chain link requires a linear shaped charge explosive density of 2,000 grains per foot and to sever a three inch diameter chain link requires a linear shaped charge explosive density of 3,200 grains per foot. As a further example, when using two linear shaped charges juxtaposed about a one inch steel bar which completely fills the opening between the upper member 20 and lower member 40, a linear shaped charge explosive density of 600 grains per foot is required.

As shown in FIG. 4, the booster charges 29 and 49 can be of any type explosive material set forth in TABLE I. However, pure RDX explosive material, cyclotrimethylenetrinitramine, contained in an aluminum housing 29' and 49' is preferred.

The exploding detonating cord 57, also called exploding cord, is a strong, flexible cord with a core containing an explosive. One commercially available detonating cord which is suitable for use is marketed under the registered trademark PRIMACORD. Examples of explosives that are suitable for use as the core of explosive material for detonating cords useful herein are set out in TABLE II below:

TABLE II

| EXPLOSIVE MATERIALS | | |
|---|---|---|
| SYMBOL | CHEMICAL NAME | FORMULA |
| RDX | Cyclotrimethylenetrinitramine, Hexahydro-1,3,5-Trinitro-5-Triazine, Cyclonite, Hexogen, T4 | $C_3H_6N_6O_6$ |
| PETN | Pentaerythrite Tetranitrate, Penta, Pentrit, Nitro Pentaerythrite | $C(CH_2NO_3)_4$ |

Figure 7:
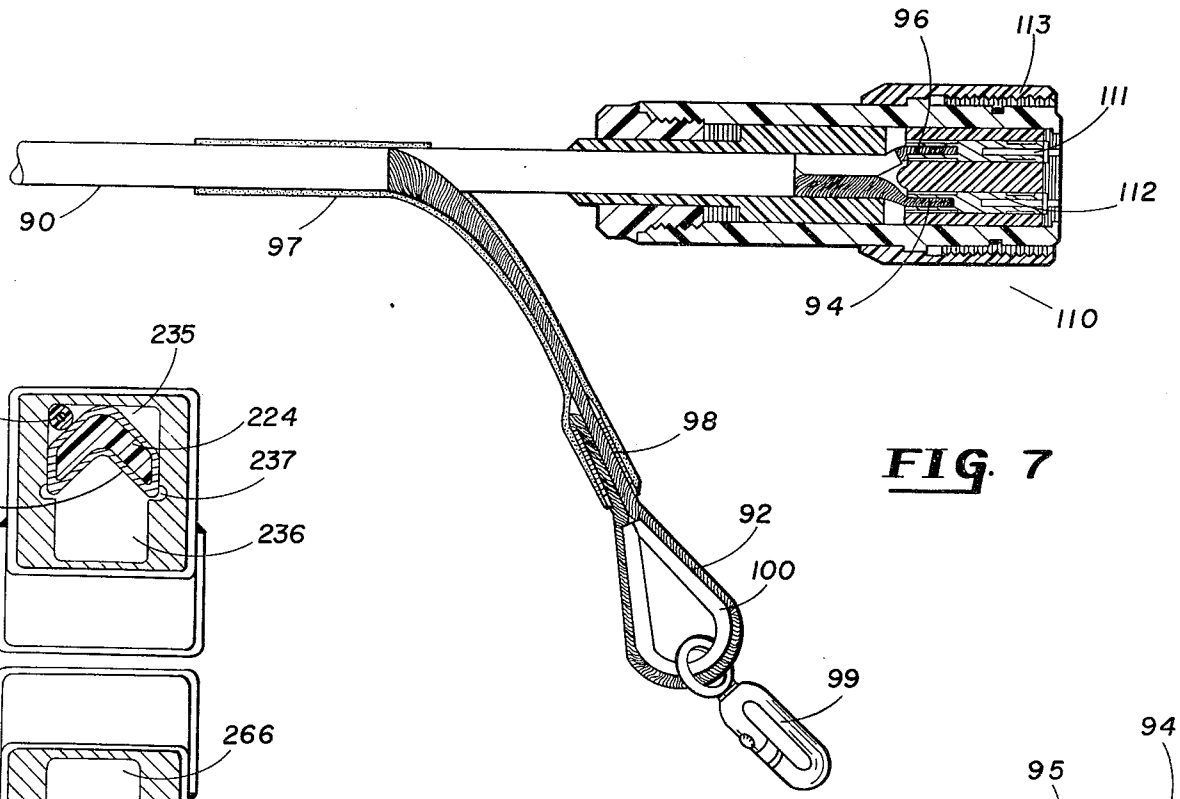
FIG. 7 is a cross-sectional view of the connector and the electric cable which mates with the connector on the cutting tool.
Figure 8:
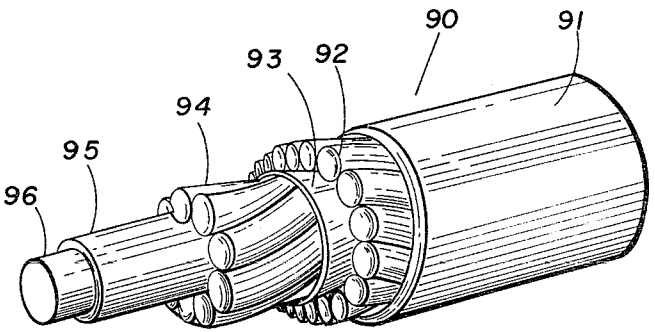
FIG. 8 is a cut-away view of the electric cable shown in FIG. 7.

As shown in FIG. 7, a connector assembly 110 and coaxial cable 90 mate with connector 81. As seen in FIG. 8, the coaxial cable 90 comprises an outer insulative covering 91, an armour sheath 92, an inner insulative covering 93, an inner conductive sheath 94, an inner most insulative covering 95 and a central conductor 96. The armour sheath 92 and inner conductive sheath 94 may be either of a spirally twisted wire as shown or may be of a woven wire type, not illustrated. Similarly, the central conductor may be either a single conductive wire or may be a mult-stranded cable, not illustrated.

The connector assembly 110 shown in FIG. 7 is a commercially available three pin type. As shown, the conductor 96 is crimped to the female type pin connector 111, while the conductive sheath 94 is crimped to the female type pin connector 112. The two female connectors 111 and 112 mate with the smaller pins 81' of connector 81 in end cap 23, which are shown in FIG. 1. A third female type pin connector, not shown, mates with the large diameter centering pin 81' of connector 81 and serves to prevent incorrect installation of the connector assembly 110 with respect to connector 81 in end cap 23. Additionally, the third female type pin connector, not shown is not connected to any conductive or insulative portion of cable 90. The connector assembly 110 also includes a threaded outer member 113 which mates with the threaded exterior of connector 81 and, when installed, provides a hermetic seal between the connector 81 and connector assembly 110.

As further shown in FIG. 7, the end of the cable 90 has the outer insulative covering 90 stripped away to expose the cable armour 92 which is subsequently connected to a halyard snap 99. The armour 92 is threaded about a cable thimble 100, lapped back and held in position by a swagged ferrule 98. The armour sheath 92 and cable 90 have a heat shrinkable tube 97 installed thereover for protection. The halyard snap 99 is installed about yoke 70 of the explosive cutting tool 10 by clipping the halyard snap 99 about the top portion of the U-shaped member 71. Since the length of the armour 92 and halyard snap 99 is less than that of the cable 90 and connector assembly 110 when installed on the explosive cutting tool 10, any tensile forces acting on the cable 90 will be transmitted to the explosive cutting tool 10 only by the armour sheath 92 and halyard snap 99.

The other end of cable 90 has a similar connector assembly 110 and halyard snap arrangement 99 for connection to any suitable power source to supply the necessary current and voltage to the EBW detonator assembly 80 for actuation.

Although not shown in the drawings, any suitable type detonating cord may be used as the detonation means in place of an exploding bridgewire detonator assembly 80. If detonating cord is used as the detonating means, another type suitable connector which will sealingly engage the cord when it passes through end cap 23 must be used in place of connector 81 shown in the drawings. Similarly, if detonating cord is used as the detonating means, the coaxial cable 90 and connector assembly 110 are no longer needed.

The working depth to which the explosive cutting device 10 may be subjected is a function of the wall thicknesses of the upper member 20 and lower member 40 respectively. If the wall thickness is 0.062 inches, the explosive cutting device 10 is suitable for use at depths up to 400 feet; if the wall thickness is 0.083 inches, the explosive cutting device 10 is suitable for use at depths up to 750 feet; and if the wall thickness is 0.120 inches, the explosive cutting device is suitable for use at depths up to 1,700 feet. Any suitable material may be used for the central members 21 and 41, although steel is preferred. Similarly, any suitable material may be used for the end caps 22, 23, 42 and 43, although an aluminum alloy is preferred.

Figure 9:
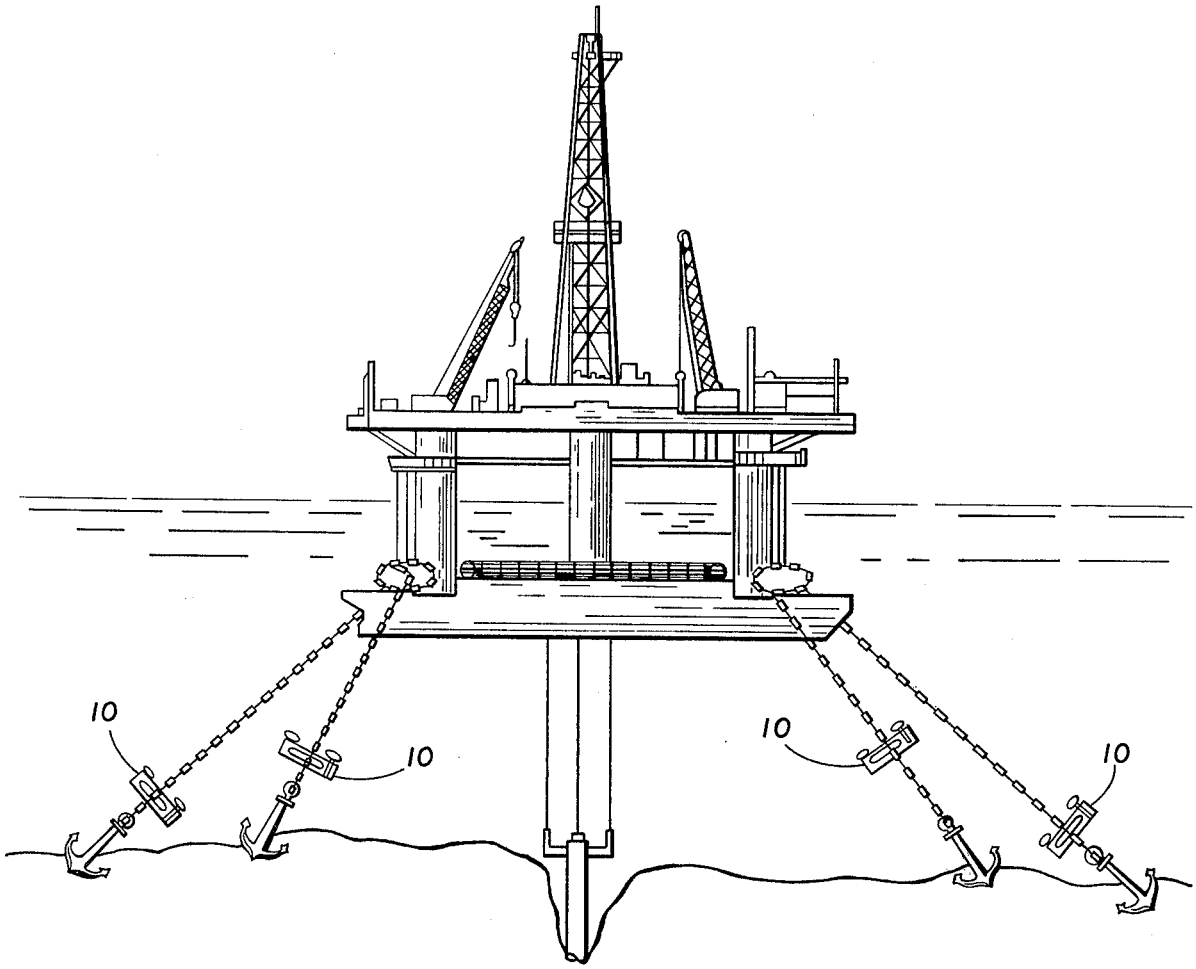
FIG. 9 is a view showing the explosive cutting device installed on an anchor chain.

As shown in FIG. 9, the explosive cutting devices 10 are installed on anchor chains anchoring a floating drilling platform in position. The explosive cutting devices 10 are not shown to scale, but are merely illustrative. Also, when installed on an anchor chain, the explosive cutting devices 10 would normally have cable 90 secured to the portion of the anchor chain running to the floating drilling platform. This feature is not illustrated in FIG. 9.

Although the upper member 20 and lower member 40 have been illustrated as being generally square in cross-sectional shaped, any geometric shaped members could be used, such as cylindrical, eliptical, hexagonal, etc.

In this connection, although the explosive cutting device 10 has been described in the preferred embodiment as being designed to sever an anchor chain link, it is envisioned that the explosive cutting device 10 can be used to sever any target material capable of being inserted within the opening between the upper member 20 and lower member 40. In such circumstances to increase the usable space between the upper member 20 and lower member 40, it would be desirable to delete the chain link spacers 33 which are attached to the upper member 20 and to form the faces 31', 32', 51' and 52' of the anti-jet distortion members into any suitable shape to substantially abut the target material inserted between the upper member 20 and the lower member 40. Although not shown, at any axial location along the explosive cutting device the anti-jet distortion members may each be a single unitary member, rather than a pair of separate members, attached to either the upper member or lower member to substantially abut the target material.

OPERATION

To install the explosive cutting device 10 about an anchor chain link to be severed, the threaded fastener 60 is initially disengaged from ears 36 and threaded member 74 is disengaged from the upper surface of the end cap 23. At this point, the upper member 20 is free to pivot with respect to the lower member 40 since the screws 75 are free to slide in the slots 76 of the yoke 70 and bellows 88, not being rigid, further allows pivoting of the upper member 20. With the upper member 20 angularly disposed with respect to the lower member 40, an anchor chain link is inserted into the opening between the upper member 20 and lower member 40 until the anchor chain link abuts arcuate surfaces 32' and 52' of anti-jet distortion members 32 and 52 respectively. The upper member 20 is subsequently pivoted towards the lower member 40 until the threaded fastener 60 may be pivoted upwardly and engaged with ears 36 of end cap 22. At this juncture, the knob 65 is merely snugged against the ears 36 either to hold the anti-jet distortion members 31 and 51 together or until the lower surface of the upper member 20 abuts the anchor chain link. The chain link spacers 33 on the upper member 20 prevent excessive movement of the anchor chain link with respect to the explosive cutter at this time since they are positioned about the anchor chain link stud link.

Next, the threaded member 74 is tightened against the upper surface of the end cap 23. Since the end cap 23 is not rigidly secured to the yoke 70, the upper member 20 is free to move towards the lower member 40 upon the tightening of threaded member 74 until the anti-jet distortion members 32 and 52 abut or until the upper member 20 abuts the anchor chain link. Although it is preferred that the anti-jet distortion members 31, 51 and 32, 52 abut when the explosive cutting device 10 is installed about an anchor chain link, normal manufacturing tolerances of the chain links sometimes prevent the anti-jet distortion members 31, 51 and 32, 52 from abutting, thereby leaving a narrow gap between the anti-jet distortion members 31, 51 and 32, 52 as shown in FIG. 1. If the anti-jet distortion members 31, 51 and 32, 52 do not abut, the threaded member 74 and the threaded fastener 60 are alternately ajusted until the gaps between the anti-jet distortion members 31, 51 and 32, 52 are equal.

After the threaded member 74 has been tightened until the anti-jet distortion members 32, 52 abut or the gaps between the anti-jet distortion members 32, 52 and 31, 51 are equal, the knob 65 on threaded fastener 60 is firmly tightened against the ears 36 on end cap 22 to prevent the threaded fastener 60 from pivoting about pin 63 thereby securing the explosive cutting device 10 about the anchor chain link.

At this point, if the explosive cutting device 10 is being installed about an anchor chain link in a dry environment, the halyard snap 99 is clipped about the U-shaped member 71 and the connector assembly 110 attached to cable 90 is mated with connector 81 on the end cap 23. Since the length of halyard snap 99 and armour sheath 92 is less than the length of the cable 90 including connector assembly 110, any tensile forces on cable 90 will be transferred to the yoke 70 rather than the mated connector assembly 110 and connector 81.

If the explosive cutting device 10 is to be installed about a submersed anchor chain link, the explosive cutting device 10 is first fitted about an anchor chain link in a dry environment to adjust the relationship between the anti-jet distortion members 31, 51 and 32, 52, and the halyard snap 99 is secured to yoke 70 with the connector assembly 110 being mated to connector 81. The explosive cutting device 10 is then removed from the anchor chain link in the dry environment and installed about the submersed anchor chain link.

The remaining end of the cable 90, connector assembly 110, and halyard snap 99 are connected and anchored, respectively, to any suitable power supply capable of reliably detonating the exploding bridgewire (EBW) detonator assembly 80. The firing system most commonly used for an EBW detonator is a capacitor discharge type. However, any type of system can be used which will supply the correct energy pulse. Other such systems in use include piezoelectric transducers and induction coils. For a typical EBW detonator which comprises a 0.001 to 0.003 inch diameter gold bridgewire in contact with a partially compressed amount of PETN explosive material having a density of approximately 1.0 grams per cubic centimeter which, in turn, is in contact with a completely compressed amount of RDX explosive material having a density of approximately 1.65 grams per cubic centimeter and yielding at least 1,385 calories per gram of energy when detonated, a typical capacitor discharge type power supply must supply an electrical impulse of 3,000 volts for one microsecond with a current flow of approximately 1,000 amperes per microsecond to detonate the EBW detonator.

If such an electrical impulse is supplied to the EBW detonators 82, 83, in each EBW detonator 82 or 83, initially, the bridgewire explodes, giving off a shock wave and the contained thermal energy. As the shock wave from the exploding bridgewire moves into the partially compressed explosive PETN material in the EBW detonator shell, a detonation of the partially compressed explosive PETN material is initiated, thereby increasing the intensity of the shock wave. As the shock wave moves through the initial partially compressed explosive PETN material and into the high energy completely compressed explosive RDX material when the completely compressed explosive RDX detonates, the intensity of the shock wave is further increased to the necessary level to breakout of the EBW detonator shell and detonate the booster charges 29 and 49. The booster charges 29 and 49, in turn, detonate their respective linear shaped charges 24 and 44. The jets of hot gases and particulate materials from the operative faces 25 and 45 of the linear shaped charges 24 and 44 respectively travel through standoff spaces 21', 27, 41' and 47 as well as through the hollow anti-jet distortion members 31, 32, 51 and 52 thereby cutting central members 21 and 41, end caps 22, 23, 42 and 43, anti-jet distortion members 31, 32, 51 and 52, and the anchor chain link to be severed. Maintaining an air space between operative faces 25 and 45 of the linear shaped charges 24 and 44 respectively and the surface of the anchor chain link as described hereinbefore is critical in underwater operations. Without the use of the anti-jet distortion members 31, 51 and 32, 52, the water distorts the jets from the linear shaped charges 24 and 44 before they can penetrate the anchor chain link to be severed unless excessively large shaped charges, far in excess of the amount of explosive material needed for severing the anchor chain link in a dry environment, are used. The anti-jet distortion members 31, 51 and 32, 52, therefore, allow the explosive cutting device 10 to be used in either a dry environment or a submersible type environment without any changes in the density of the explosive material or in explosive charge size.

Since the standoff spaces 21' and 27 in the upper member 20, the standoff spaces 41' and 47 in the lower member 40, and the anti-jet distortion spaces in the hollow anti-jet distortion members 31, 51 and 32, 52, respectively, are critical, these spaces must be sealed to prevent the ingress of water. As described hereinbefore, this is accomplished by welding the anti-jet distortion members 31, 51 and 32, 52 to their respective central members 21 and 41 and pressure checking them for leaks, by adhesively sealing the end caps 22, 23 and 42, 43 to their respective central members 21 and 41, and by filling the cavities 38 and 56 of their respective end caps 23 and 43 with potting material to insure the hermetic sealing of the end caps to their central members.

To insure that both linear shaped charges 24 and 44 are simultaneously detonated in case of the failure of either one of the EBW detonators 82 or 83 and to insure the shock wave emanating from the EBW detonators 82 and 83 is sufficient to detonate the respective booster charges 29 and 49, a detonating cord 57 is installed in end caps 23 and 43 in conjunction with the EBW detonators. The detonating cord 57 is merely a redundant feature to insure reliability of the explosive cutting device 10.

ALTERNATIVE EMBODIMENT

Figure 10:
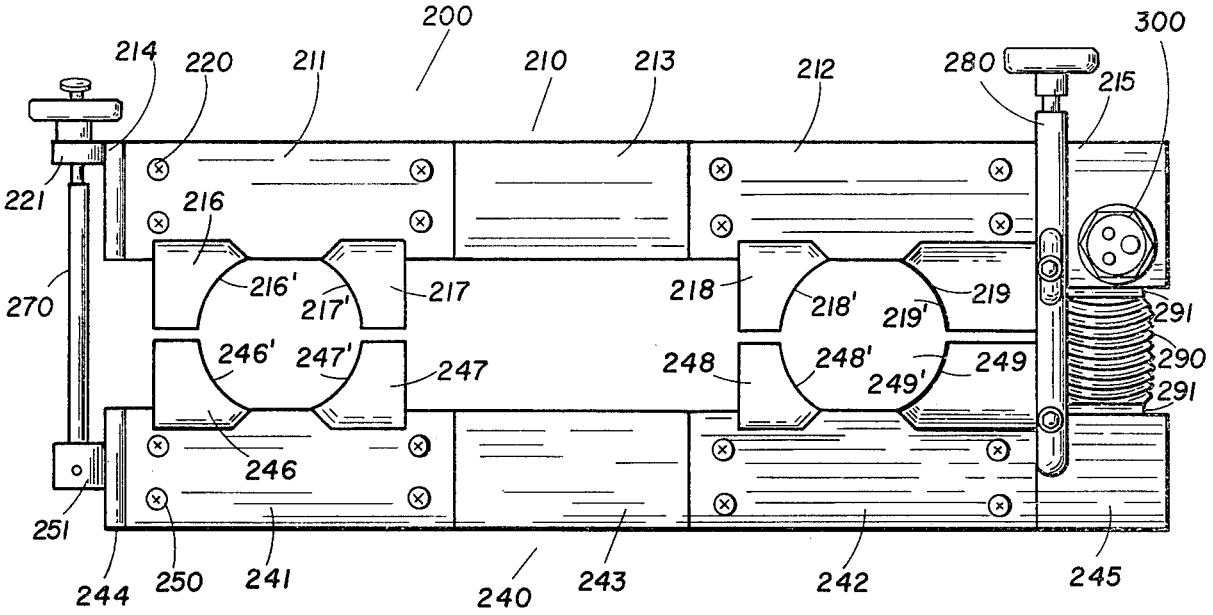
FIG. 10 is a front view of an alternative embodiment of the explosive cutting device.

Shown in FIG. 10 is an alternative embodiment of the invention. Although very similar to the explosive cutting device 10 shown in FIGS. 1 through 9, the explosive cutting device 200 is for use where two or more completely separate members are to be severed, such as two rods, cables or lines.

As shown in FIG. 10, the explosive cutting device 200 comprises an upper member 210 and a lower member 240.

The upper member 210 comprises a hollow end member 211, solid central member 213, hollow end member 212, end caps 214 and 215, and anti-jet distortion members 216, 217, 218 and 219. The end caps 214 and 215 are secured to end members 211 and 212 respectively by means of screws 220 and any suitable adhesive material (not shown) capable of forming a hermetic seal between the end caps 214 and 215 and the end members 211 and 212. The end members 211 and 212 are secured to central member 213 by means of screws 220 and any suitable adhesive material (not shown) capable of forming a hermetic seal between the end members 211 and 212 and the central member 213. The anti-jet distortion members 216, 217, 218 and 219 are welded to their respective end members 211 and 212 and are pressure checked after welding to insure a hermetic seal between the anti-jet distortion members 216, 217, 218 and 219 and the end members 211 and 212. The anti-jet distortion members 216, 217, 218 and 219 are formed with arcuate faces 216', 217', 218' and 219' respectively to substantially abut the periphery of the target member to be severed.

Similar to the upper member 210, the lower member 240 comprises a hollow end member 241, solid central member 243, hollow end member 242, end caps 244 and 245, and anti-jet distortion members 246, 247, 248 and 249. The end caps 242 and 243 are secured to the end members 241 and 242 respectively by means of screws 230 and any suitable adhesive material (not shown) capable of forming a hermetic seal between the end caps 244 and 245 and the end members 241 and 242. The end members 241 and 242 are secured to central member 243 by means of screws 250 and any suitable adhesive material (not shown) capable of forming a hermetic seal between the end members 241 and 242 and the central member 243. The anti-jet distortion members 246, 247, 248 and 249 are welded to their respective end members 241 and 242 and are pressure checked after welding to insure a hermetic seal between the anti-jet distortion members 246, 247, 248 and 249 and the end members 241 and 242. The anti-jet distortion members 246, 247, 248 and 249 are formed with arcuate faces 246', 247', 248' and 249' respectively to substantially abut the periphery of the target member to be severed.

As shown in FIG. 10, one end of the upper member 210 and lower member 240 is connected by a yoke 280 while the other end of the upper member 210 and lower member 240 is connected by a pivotally threaded fastener 270. The yoke 280 and pivotally threaded fastener 270 are identical to the yoke 70 and pivotally threaded fastener 60 described hereinbefore, and will not be described in detail with respect to the alternative embodiment explosive cutting device 200.

The upper member 210 and lower member 240 are further connected by a bellows 290 mating with end cap 215 and end cap 245. The bellows 290 is held in position by means of adjustable metal bands 291 or by means of any suitable adhesive material.

The end cap 215 of upper member 210 further contains a threaded electrical connector 300 which is identical to connector 81 described hereinbefore.

Figure 11:
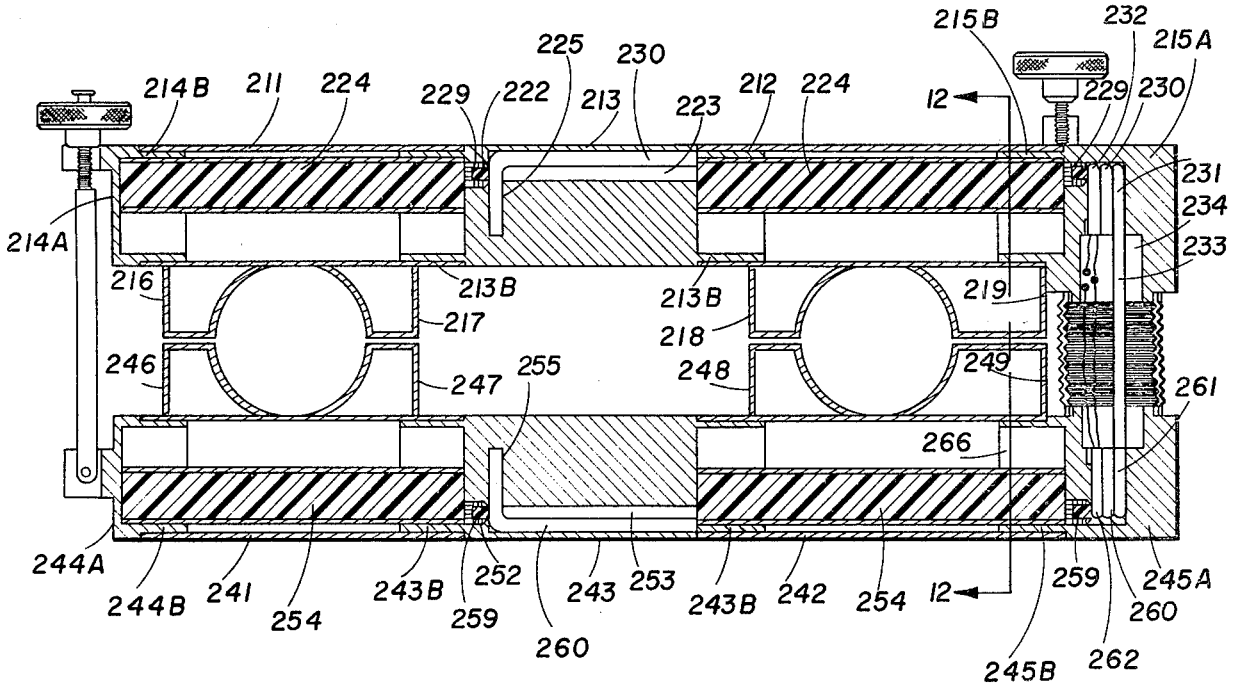
FIG. 11 is a cross-sectional view of the alternative embodiment of the invention with the explosive charge shown in full cross section.

As shown in FIG. 11, the upper member 210 contains two separate linear shaped charges 224 which are separated by the central member 213 and posiitioned in the upper portion of the end members 211 and 212. The linear shaped charges 224 extend the length of the end members 211 and 212 and into end caps 214 and 215 as well as a portion of the central member 213. The end cap 214 is identical to the end cap 22 described hereinbefore and as shown in FIG. 1 and FIG. 4. The end cap 215 is identical to the end cap 23 described hereinbefore and as shown in FIG. 1 and FIG. 4, except for a bore (not shown) in end cap wall 215A for the explosive detonating cord 230 and bore 231 in the end cap 215.

The central member 213 is formed with reduced thickness end walls 213B which mate with end members 211 and 213 to form a flush joint when assembled. The central member 213 further includes axial bore 223 for explosive detonating cord 230, bore 222 for booster charge 229 and slot 225 for the end of explosive detonating cord 230.

The end cap 215 includes an EBW detonator 232, an exploding detonating cord 230 and an exploding detonating cord 233 which are all contained in bore 231 of the end cap 215. Although not shown in the drawings, after the EBW detonator 232, the exploding detonating cord 230 and exploding detonating cord 233 are installed in bore 231, the cavity 234 in end cap 215 is filled with any suitable potting material to hermetically seal the end cap 215.

As shown in FIG. 11, the anti-jet distortion members 216, 217, 218 and 219 are hollow, although they could be of solid material.

Similar to upper member 210, the lower member 240 contains two separate linear shaped charges 254 which are separated by the central member 213 and positioned in the lower portion of the end members 241 and 242. The linear shaped charges 254 extend the length of the end members 241 and 242 and into end caps 244 and 245 as well as a portion of central member 243. The end cap 244 is identical to the end cap 42 described hereinbefore and as shown in FIG. 1 and FIG. 4. The end cap 245 is identical to the end cap described hereinbefore and shown in FIG. 1 and FIG. 4, except for a bore (not shown) in the end cap wall 245A for the explosive detonating cord 260 and bore 261 in the end cap 245.

The central member 243 is formed with reduced thickness end walls 243B which mate with end members 241 and 242 to form a flush joint when assembled. The central member 243 further includes axial bore 253 for explosive detonating cord 260, bore 252 for booster charge 259 and slot 255 for the end of explosive detonating cord 260.

The end cap 245 includes an EBW detonator 262, an exploding detonating cord 260 and an exploding detonating cord 233 which are all contained in bore 261 of the end cap 245. Although not shown in the drawings, after the EBW detonator 262, the exploding detonating cord 260 and exploding detonating cord 233 are installed in bore 261, the cavity 264 in end cap 245 is filled with any suitable potting material to hermetically seal the end cap 245.

As shown, the anti-jet distortion members 246, 247, 248 and 249 are hollow, although they could be of solid material.

Figure 12:
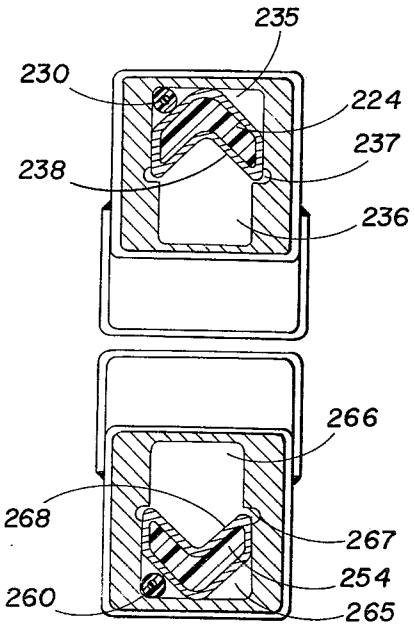
FIG. 12 is an enlarged cross-sectional view taken along lines 12—12 of FIG. 11.

As shown in FIG. 12, the end caps 215 and 245 are divided into charge retaining areas 235 and 265 containing shaped charges 224 and 254 as well as exploding detonating cords 230 and 260 respectively, and smaller standoff areas 236 and 266 by means of shoulders 237 and 267 respectively. As further shown, the linear shaped charges 224 and 254 are installed with their operative faces 238 and 268, respectively, facing the standoff areas 236 and 266. Although not shown in cross-section, the central members 213 and 243 each have their ends configured to provide a standoff area and a charge retaining area similar to that shown in the drawings for end caps 215 and 245.

It should be noted that the linear shaped charges 224 and 254, the booster charges 229 and 259, the exploding detonating cords 230, 260 and 233, and the EBW detonators 232 and 262 are identical as far as material composition and operation to those described in the preferred embodiment of the explosive cutting device 10 shown in FIGS. 1 through 9.

In contrast to the preferred embodiment, the explosive cutting device 200 shown in FIGS. 10 through 12 has anti-jet distortion members 216, 217, 218, 219, 246, 247, 248 and 249 which substantially surround the target members to be severed.

The explosive cutting device 200 has as its primary use those applications where two completely separated members are to be severed. To prevent excessively large linear shaped charges from being required to sever the target members, anti-jet distortion devices 217, 218, 247 and 248 must be provided to allow the jets emanating from the operative faces 238 and 268 of linear shaped charges 224 and 254 respectively to remain undistorted by the surrounding environment to insure complete severing of the target members. Without the presence of anti-jet distortion members 216, 217, 218, 219, 246, 247, 248 and 249, if the explosive cutting device 10 is in a submerged environment, upon detonation the jets emanating from the linear shaped charges 224 and 254 will be distorted and not sever the target members completely about their periphery.

Although the explosive cutting device 200 is illustrated with the upper member 210 and lower member 240 as being square in cross-sectional shape and being configured to sever two cylindrical shaped target members, the upper member 210 and lower member 240 of the explosive cutting device 200 may be of any cross-sectional shape and may be configured to sever any number of target members which may be of any cross-sectional shape with the arcuate faces 216', 217', 218', 219', 245', 247', 248' and 249' substantially corresponding to the cross-sectional shape of the target members.

Furthermore, while the upper member 210 and lower member 240 have been illustrated as comprising two end members and a central member which, therefore, requires the use of two linear shaped charges 224 and 254 in the upper member 210 and lower member 240 respectively, the upper member 210 and lower member 240, each, could be formed as a single central member having a single linear shaped charge therein.

Similar to the preferred embodiment shown in FIGS. 1 through 10, the explosive cutting device 200 has end caps 214, 215, 244 and 245 constructed of an aluminum alloy as well as central members 213 and 243 while the end members 211, 212, 241 and 242 and anti-jet distortion members 216, 217, 218, 219, 246, 247, 248 and 249 are of steel. In this connection, when explosive cutting device 200 is constructed with material thicknesses equal to that of the preferred embodiment, shown in FIGS. 1 through 9, it is suitable for use to similar operating depths.

Unless otherwise described, the explosive cutting device 200 has components and elements identical in construction and operation to those described in the preferred embodiment in FIGS. 1 through 9 with similar modifications or substitutions as described in the description of the preferred embodiment being applicable to the alternative embodiment.

OPERATION

The mode of operation and installation of the explosive cutting device 200 is similar to that of the preferred embodiment. When the EBW detonators 232 and 262 are simultaneously detonated, they in turn, detonate booster charges 229 and 259, exploding detonating cord 233 and exploding detonating cords 230 and 260. The exploding detonating cords 230 and 260, in turn, detonate booster charges 229 and 259 in central members 213 and 243, respectively. At this point, linear shaped charges 224 and 254 in end members 211, 212 and 241, 242 are detonated thereby causing jets of hot gases and particulate material to cut through the end members 211, 212, 241 and 242, end caps 214, 215, 244 and 245, portions of central members 213 and 243, anti-jet distortion members 216, 217, 218, 219, 246, 247, 248 and 249 and the target members to be severed. As described hereinbefore, the anti-jet distortion members allow the jets emanating from linear shaped charges 224 and 254 to become fully developed and remain undistorted by the surrounding environment to sever the target members completely about their periphery without requiring the use of excessively large linear shaped charges.

Since the mode of operation and composition of the explosive materials of explosive cutting device 200 are identical to that of the primary embodiment set forth hereinbefore, a detailed description of the mode of operation and construction of the EBW detonators 232 and 262, the booster charges 229, the exploding detonating cords 230, 233 and 260, and the linear shaped charges 224 and 254 has not been set forth in this section.

It is envisioned that the explosive cutting devices 10 and 200 can be used in any type environment to sever any target member or members capable of being inserted within the opening between the upper and lower members. To effect severing of a target member the explosive cutting devices 10 and 200 need only to have the jets emanating from the operative faces of the linear shaped charges remain undistorted by the surrounding environment. To prevent jet distortion, anti-jet distortion members are provided about the periphery of the target member to be severed. Thus, it is my intention that the following claims encompass the broad range of equivalents to which they are entitled.

What is claimed is:

1. An explosive cutting device for severing a chain link surrounded by liquid, said explosive cutting device comprising:

a substantially linear upper member having a charge retaining area and a standoff area;

a linear shaped explosive charge contained within the charge retaining area of said upper member;

a pair of anti-jet distorsion members located on said upper member;

a substantially linear lower member having a charge retaining area and a standoff area;

a linear shaped explosive charge contained within the charge retaining area of said lower member;

a pair of anti-jet distorsion members located on said lower member juxtaposed from said pair of anti-jet distorsion members located on said upper member, said pair of anti-jet distorsion members located on said upper member and said pair of anti-jet distorsion members located on said lower member defining an opening between said upper member and said lower member to receive said chain link therein with a portion of each anti-jet distorsion member of said pair of anti-jet distorsion members on said upper member and said pair of anti-jet distorsion members on said lower member confronting a portion of said chain link;

fastening means for securing said upper member to said lower member; and means for detonating said linear shaped explosive charge within said upper member and said lower member.

2. An explosive cutting device comprising:

an upper member having a charge retaining area and a standoff area;

a linear shaped explosive charge contained within the charge retaining area of said upper member;

a first pair and a second pair of members located on said upper member;

a lower member having a charge retaining area and a standoff area;

a linear shaped explosive charge contained within the charge retaining area of said lower member;

a first pair of members and a second pair of members located on said lower member juxtaposed from said first pair of members and said second pair of members located on said upper member, said first pair of members and said second pair of members located on said upper member and said first pair of members and said second pair of members located on said lower member defining a first opening and a second opening between said upper member and said lower member.

3. The explosive cutting device of claim 1 wherein the means for detonating the linear shaped explosive charge within said upper member and said lower member comprises an exploding bridgewire detonator.

4. The explosive cutting device of claim 1 wherein the means for detonating the linear shaped explosive charge within said upper member and said lower member comprises exploding detonating cord.

5. The explosive cutting device of claim 1 further comprising:

a booster explosive charge located between the linear shaped explosive charge within said upper member and the means for detonating the linear shaped explosive charge within said upper member; and a booster explosive charge located between the linear shaped explosive charge within said lower member and the means for detonating the linear shaped explosive charge within said lower member.

6. The explosive cutting device of claim 1 wherein said pair of anti-jet distorsion members located on said upper member and said pair of anti-jet distorsion members located on said lower member are hollow.

7. The explosive cutting device of claim 1 wherein said upper member, said pair of anti-jet distorsion members located on said upper member, said lower member and said pair of anti-jet distorsion members located on said lower member are hermetically sealed.

8. The explosive cutting device of claim 5 further comprising an exploding detonating cord having one end adjacent said means for detonating the linear shaped explosive charge within said upper member and having the other end adjacent said means for detonating the linear shaped explosive charge within said lower member.

9. The explosive cutting device of claim 1 further comprising an exploding detonating cord having one end adjacent said means for detonating the explosive charge within said upper member and having the other end adjacent said means for detonating the linear shaped explosive charge within said lower member.

10. The explosive cutting device of claim 2 wherein the means for detonating the linear shaped explosive charge within said upper member and said lower member comprises an exploding bridgewire detonator.

11. The explosive cutting device of claim 2 wherein the means for detonating the linear shaped explosive charge within said upper member and said lower member comprises exploding detonating cord.

12. The explosive cutting device of claim 2 further comprising:

a booster explosive charge located between the linear shaped explosive charge within said upper member and the means for detonating the linear shaped explosive charge within said upper member; and a booster explosive charge located between the linear shaped explosive charge within said lower member and the means for detonating the linear shaped explosive charge within said lower member.

13. The explosive cutting device of claim 2 wherein said first and second pairs of members located on said upper member and the first and second pairs of members located on said lower member are hollow.

14. The explosive cutting device of claim 2 wherein said upper member, said first and second pairs of members located on said upper member, said lower member, and said first and second pairs of members located on said lower member are hermetically sealed.

15. The explosive cutting device of claim 12 further comprising an exploding detonating cord having one end adjacent said means for detonating the linear shaped explosive charge within said upper member and having the other end adjacent said means for detonating the linear shaped explosive charge within said lower member.

16. The explosive cutting device of claim 2 further comprising an exploding detonating cord having one end adjacent said means for detonating the explosive charge within said upper member and having the other end adjacent said means for detonating the linear shaped explosive charge within said lower member.

17. An explosive cutting device for severing a chain link surrounded by liquid, said explosive cutting device comprising:

a substantially linear hermetically sealed upper member having a charge retaining area and a standoff area;

a linear shaped explosive charge contained within the charge retaining area of said upper member;

a hermetically sealed pair of hollow anti-jet distorsion members located on said upper member;

a substantially linear hermetically sealed lower member having a charge retaining area and a standoff area;

a linear shaped explosive charge contained within the charge retaining area of said lower member;

a hermetically sealed pair of hollow anti-jet distorsion members located on said lower member juxtaposed from the hermetically sealed pair of hollow anti-jet distorsion members located on said upper member; said hermetically sealed pair of hollow anti-jet distorsion members located on said upper member and said hermetically sealed pair of hollow anti-jet distortion members located on said lower member defining an opening between said upper member and said lower member to receive said chain link therein with a portion of each hollow anti-jet distorsion member of said pair of hollow anti-jet distorsion members located on said upper member and said lower member confronting a portion of said chain link;

means for detonating said linear shaped explosive charge within said upper member and said lower member;

a booster explosive charge located between said linear shaped explosive charge within said upper member and said means for detonating said linear shaped explosive charge within said upper member;

a booster explosive charge located between said linear shaped explosive charge within said lower member and said means for detonating said linear shaped explosive charge within said lower member;

an exploding detonating cord having one end adjacent said means for detonating said linear shaped explosive charge within said upper member and having the other end adjacent said means for detonating said linear shaped explosive charge within said lower member; and fastening means for securing said upper member to said lower member.

18. The explosive cutting device of claim 17 wherein said means for detonating the linear shaped explosive charge within said upper member and said lower member comprises an exploding bridgewire detonator.

19. The explosive cutting device of claim 17 wherein said means for detonating the linear shaped explosive charge within said upper member and said lower member comprises an exploding detonating cord.

20. An explosive cutting device for severing a chain link surrounded by liquid, said explosive cutting device comprising:

a substantially linear hermetically sealed upper member having a charge retaining area and a standoff area;

a linear shaped explosive charge contained within the charge retaining area of said upper member;

a hermetically sealed pair of hollow anti-jet distorsion members located on said upper member;

a substantially linear hermetically sealed lower member having a charge retaining area and a standoff area;

a linear shaped explosive charge contained within the charge retaining area of said lower member;

a hermetically sealed pair of hollow anti-jet distorsion members located on said lower member juxtaposed from the hermetically sealed pair of hollow anti-jet distorsion members located on said upper member, said hermetically sealed pair of hollow anti-jet distorsion members located on said upper member and said hermetically sealed pair of hollow anti-jet distorsion members located on said lower member defining an opening between said upper member and said lower member to receive said chain link therein with a portion of each hollow anti-jet distorsion member of said pair of hollow anti-jet distorsion members located on said upper member and said lower member confronting a portion of said chain link;

exploding bridgewire detonating means for detonating said linear shaped explosive charge within said upper member and said lower member;

a booster explosive charge located between said linear shaped explosive charge within said upper member and said exploding bridgewire detonating means for detonating said linear shaped explosive charge within said upper member;

a booster explosive charge located between said linear shaped explosive charge within said lower member and said exploding bridgewire detonating means for detonating said linear shaped explosive charge within said lower member;

an exploding detonating cord having one end adjacent said exploding bridgewire detonating means for detonating said linear shaped explosive charge within said upper member and having the other end adjacent said exploding bridgewire detonating means for detonating said linear shaped explosive charge within said lower member; and fastening means for securing said upper member to said lower member.

21. An explosive cutting device comprising:

an upper member having a charge retaining area and a standoff area;

a linear shaped explosive charge contained within the charge retaining area of said upper member;

a plurality of pairs of members located on said upper member;

a lower member having a charge retaining area and a standoff area;

a linear shaped explosive charge contained within the charge retaining area of said lower member;

a plurality of pairs of members located on said lower member juxtaposed from the plurality of pairs of members located on said upper member, the plurality of pairs of members located on said upper member and the plurality of pairs of members located on said lower member defining a series of openings between said upper member and said lower member;

fastening means for securing said upper member to said lower member; and means for detonating the linear shaped explosive charge within said upper member and said lower member.

22. The explosive cutting device of claim 21 wherein the means for detonating the linear shaped explosive charge within said upper member and said lower member comprises an exploding bridgewire detonator.

23. The explosive cutting device of claim 21 wherein the means for detonating the linear shaped explosive charge within said upper member and said lower member comprises exploding detonating cord.

24. The explosive cutting device of claim 21 further comprising:

a booster explosive charge located between the linear shaped explosive charge within said upper member and the means for detonating the linear shaped explosive charge within said upper member; and a booster explosive charge located between the linear shaped explosive charge within said lower member and the means for detonating the linear shaped explosive charge within said lower member.

25. The explosive cutting device of claim 21 wherein the plurality of pairs of members located on said upper member and the plurality of pairs of members located on said lower member are hollow.

26. The explosive cutting device of claim 21 wherein said upper member, the plurality of pairs of members located on said upper member, said lower member and the plurality of pairs of members located on said lower member are hermetically sealed.

27. The explosive cutting device of claim 21 further comprising an exploding detonating cord adjacent said means for detonating the linear shaped explosive charge within said upper member and said lower member.

28. An explosive cutting device for severing a chain link surrounded by liquid, said explosive cutting device comprising:

a substantially linear upper member having a charge retaining area and a standoff area;

a linear shaped explosive charge contained within the charge retaining area of said upper member;

a substantially linear lower member having a charge retaining area and a standoff area;

a linear shaped explosive charge contained within the charge retaining area of said lower member;

a pair of anti-jet distorsion members located on said upper member defining an opening between said upper member and said lower member to receive said chain link therein with a portion of each anti-jet distorsion member of said pair of anti-jet distorsion members on said upper member confronting a porition of said chain link when said lower member abuts said pair of anti-jet distorsion members located on said upper member;

means for detonating said linear shaped explosive charge within said upper member and said lower member; and fastening means for securing said upper member to said lower member.

29. An explosive cutting device for severing a chain link surrounded by liquid, said explosive cutting device comprising:

a substantially linear upper member having a charge retaining area and a standoff area;

a linear shaped explosive charge contained within the charge retaining area of said upper member;

a substantially linear lower member having a charge retaining area and a standoff area;

a linear shaped explosive charge contained within the charge retaining area of said lower member;

a pair of anti-jet distorsion members located on said lower member defining an opening between said upper member and said lower member to receive said said chain link therein with a portion of each anti-jet distorsion member of said pair of anti-jet distorsion members on said lower member confronting a portion of said chain link when said upper member abuts said pair of anti-jet distorsion members located on said lower member;

means for detonating said linear shaped explosive charge within said upper member and said lower member; and fastening means for securing said upper member to said lower member.

30. An explosive cutting device comprising:

an upper member having two charge retaining areas and two standoff areas;

two linear shaped explosive charges contained within the two charge retaining areas of said upper member;

two pairs of members located on said upper member;

a lower member having two charge retaining areas and two standoff areas;

two linear shaped explosive charges contained within the two charge retaining areas of said lower member;

two pairs of members located on said lower member juxtaposed from the two pairs of members located on said upper member, the two pairs of members located on said upper member and the two pairs of members located on said lower member defining two openings between said upper member and said lower member;

a detonating means for detonating one of the two linear shaped explosive charges within said upper member and said lower member;

a booster explosive charge located between the linear shaped explosive charge within said upper member and the detonating means for detonating one of the two linear shaped explosive charges within said upper member;

a booster explosive charge located between the linear shaped explosive charge within said lower member and the detonating means for detonating one of the two linear shaped explosive charges within said lower member;

an exploding detonating cord having one end adjacent the detonating means for detonating one of the two linear shaped explosive charges within said upper member and having the other end terminating adjacent the second linear shaped explosive charge in said upper member;

an exploding detonating cord having one end adjacent the detonating means for detonating one of the two linear shaped explosive charges within said lower member and having the other end terminating adjacent the second linear shaped explosive charge in said lower member;

a booster explosive charge located between the other end of the exploding detonating cord and the second linear shaped explosive charge in said upper member;

a booster explosive charge located between the other end of the exploding detonating cord and the second linear shaped explosive charge in said lower member; and fastening means for securing said upper member to said lower member.

31. The explosive cutting device of claim 30 wherein the means for detonating one of the two linear shaped explosive charges contained within said upper member and said lower member comprises an exploding bridge-wire detonator.

32. The explosive cutting device of claim 30 wherein the means for detonating one of the two linear shaped explosive charges contained within said upper member and said lower member comprises exploding detonating cord.

33. The explosive cutting device of claim 30 wherein the two pairs of members located on said upper member and the two pairs of members located on said lower member are hollow.

34. The explosive cutting device of claim 30 wherein said upper member, the two pairs of members located on said upper member, said lower member and the two pairs of members located on said lower member are hermetically sealed.

35. The explosive cutting device of claim 30 further comprising an exploding detonating cord having one end adjacent the one end of the exploding detonating cord in said upper member and having the other end adjacent the one end of the exploding detonating cord in said lower member.

36. The explosive cutting device of claim 1 further comprising:

chain link spacer means secured to said upper member to position said explosive cutting device with respect to said chain link.

37. The explosive cutting device of claim 17 further comprising:

chain link spacer means secured to said upper member to position said explosive cutting device with respect to said chain link.

* * * * *